US008651733B2

(12) United States Patent
Saunier

(10) Patent No.: US 8,651,733 B2
(45) Date of Patent: Feb. 18, 2014

(54) TIMEPIECE

(75) Inventor: Andre Saunier, Courgenay (CH)

(73) Assignee: Paul Hartzband, Brookfield, CT (US)

( * ) Notice: Subject to any disclaimer, the term of this patent is extended or adjusted under 35 U.S.C. 154(b) by 0 days.

(21) Appl. No.: 13/635,956

(22) PCT Filed: Mar. 21, 2011

(86) PCT No.: PCT/EP2011/054278
§ 371 (c)(1),
(2), (4) Date: Sep. 19, 2012

(87) PCT Pub. No.: WO2011/117209
PCT Pub. Date: Sep. 29, 2011

(65) Prior Publication Data

US 2013/0010577 A1 Jan. 10, 2013

(30) Foreign Application Priority Data

Mar. 20, 2010 (CH) ..... 404/10

(51) Int. Cl.
*G04B 17/04* (2006.01)

(52) U.S. Cl.
USPC ..... 368/175

(58) Field of Classification Search
USPC ..... 368/124, 127–131, 133, 139–140, 368/168–178, 158, 161; 267/273, 156; 968/111; 29/896.9
See application file for complete search history.

(56) References Cited

U.S. PATENT DOCUMENTS

| | | | | |
|---|---|---|---|---|
| 7,452,123 | B2 * | 11/2008 | Girardin et al. | 368/140 |
| 8,118,480 | B2 * | 2/2012 | Gigandet et al. | 368/133 |
| 2008/0205200 | A1 * | 8/2008 | Spode et al. | 368/172 |

FOREIGN PATENT DOCUMENTS

| | | |
|---|---|---|
| CH | 4 367 | 4/1892 |
| CH | 16447 | 11/1898 |
| CH | 30 608 | 12/1904 |
| CH | 126616 | 7/1928 |
| CH | 280237 | 1/1952 |
| CH | 336 008 | 1/1959 |
| CH | 533856 | 10/1972 |
| FR | 2184949 | 12/1973 |
| GB | 1397492 | 6/1975 |
| JP | 49017664 | 5/1974 |

OTHER PUBLICATIONS

International Search Report dated Aug. 24, 2011, corresponding to PCT/EP2011/054278.
Swiss Search Report dated Dec. 6, 2010, corresponding to the Foreign Priority Application No. CH00404/10.

* cited by examiner

*Primary Examiner* — Edwin A. Leon
(74) *Attorney, Agent, or Firm* — Young & Thompson

(57) ABSTRACT

A timepiece includes: a movement (10) that has a balance wheel/spring assembly (12) having a system for adjusting the operative length of the spring, which is rotatable; a control member (14) that is accessible, by the user, outside the timepiece; a transmission wheel (22) that is rotatably mounted, on the periphery of the movement (10), onto a frame, the movement (10) being placed inside the transmission wheel, the transmission wheel (22) being kinematically connected or connectable to the control member (14) and moreover being kinematically connected to the adjustment system; and a display part (30) that is kinematically connected to the transmission wheel (22) and drives a display member, intended for displaying the adjustment value that is applied to the operative length of the spring. The display part (30) is formed of movable parts that are mounted onto a first separate module, assembled to the frame.

22 Claims, 10 Drawing Sheets

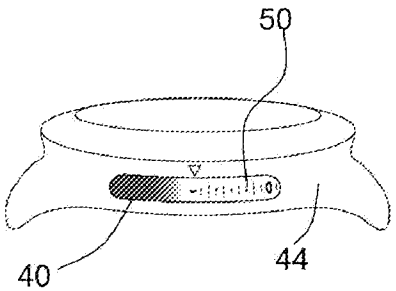
Fig. 5b
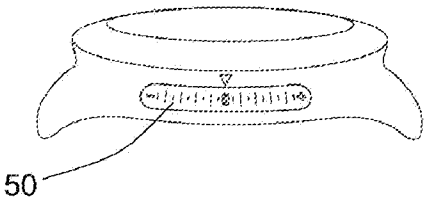

TIMEPIECE

TECHNICAL FIELD

The present invention relates to the field of mechanical horology. It more particularly relates to a timepiece comprising:

- a movement provided with a sprung balance associated with a balance-spring, equipped with a system for adjusting the active length of said balance-spring,
- a control organ accessible by a user from outside the timepiece,
- a transmission system kinematically connected on the one hand to the control organ and on the other hand to said adjustment system.

STATE OF THE ART

In a mechanical movement, the regulator organ that imparts the precision to the movement is, in typical cases, a balance associated with a balance-spring. The operating precision can be adjusted by adjusting the active length of the balance-spring. This adjustment is typically obtained by an index assembly system, known by those skilled in the art. According to the Berner clockwork dictionary, the index is a steel part with two arms, the shorter of which carries the pins embracing the spring, the other one acting as a pointer, the end of which can move across from a division, with the indications F-S (fast-slow). The index is adjusted with friction fit on the top balance-endpiece. The daily operation of the watch is modified by turning the index, which modifies the active length of the balance-spring; the divisions marked on the neck allow an approximate assessment of the effect of the correction, the indication being given by the long arm.

It is known that the operating precision of a movement can fluctuate over time, under the effect of various parameters, in particular related to the aging of its components or the lubricants applied, which can modify the energy losses that occur due to friction. The temperature to which the movement may be exposed, any impacts may also modify the adjustment of the movement.

In the usual embodiments, it is necessary to open the watch case to access the index. This type of adjustment is therefore normally reserved for horologists.

Certain embodiments of the state of the art have proposed timepieces provided with a control organ accessible to a user from outside the timepiece, making it possible to act on the index, via a control organ.

For example, reference may be made to document CH280237, which proposes to adjust the operation using a screw secured to an arm arranged to act on the index. A second arm makes it possible to move an angular sector across from an index to display the adjustment. Such a system is very bulky, in particular in relation to the surface area occupied by the arms. The kinematic connection between the screw and the index is also relatively imprecise.

Document CH30608 proposes an adjustment system actuated directly by the display index, the latter being secured to a ring rotatably mounted in reference to the movement. The ring has, on its inner flank, an inclined plane on which the end of the long arm of the index is pressed by a spring. Moving the index thus makes it possible to pivot the index. This system has one major drawback, since actuating the index requires access to the organs arranged on the dial. The risks of damaging the hands, misaligning them, or introducing dust into the case are particularly great.

The present invention aims to propose a timepiece provided with a system for adjusting the active length of the balance-spring equipping it, accessible from outside the timepiece, free from the aforementioned drawbacks.

BRIEF DESCRIPTION OF THE INVENTION

More specifically, the invention relates to a timepiece comprising:

- a movement provided with a sprung balance associated with a spring-balance, equipped with a system for adjusting the active length of said spring-balance, rotatably movable,
- a control organ accessible to a user from outside the timepiece,
- a transmission ring rotatably mounted on the periphery of the movement on a frame, said movement being arranged inside said transmission ring, the transmission ring on the one hand being kinematically connected or connectable to the control organ, and on the other hand kinematically connected to said adjustment system,
- a display train kinematically connected to the transmission ring and driving an indicator organ, designed to display the value of the adjustment applied to the active length of the spring-balance.

The timepiece according to the invention comprises one or more of the following features, possibly in combination.

- The display train is made up of wheels mounted on a first independent module, assembled to said frame.
- The transmission ring is kinematically connected to the adjustment system by a transmission train made up of wheels mounted on a second independent module, assembled to said frame.
- It comprises means for displaying a service indication indicating that the movement of the adjustment system has exceeded a predetermined value.
- The movement is housed in a case closed by a bottom and a glass, said movement being topped by a dial visible through the glass. The transmission ring bears a marking and the dial, the case or the bottom comprises an opening through which said marking is visible, to indicate the service information.
- The position of the adjustment system can be locked.
- The position of the adjustment system can be locked by locking the transmission ring.
- The rotation of the transmission ring can be blocked by at least one ball click arranged to cooperate with a plurality of housings, the ball click system or the plurality of housings being arranged in the transmission ring or in the frame.
- The transmission ring comprises a braking surface and said timepiece comprises a locking member accessible from outside the timepiece, secured to a brake arranged to cooperate with the braking surface. Said locking member is movably mounted and is capable of going between a first state in which the brake bears against the braking surface, and a second state in which the brake leaves the braking surface free, a locking spring being arranged to exert a force on the locking member tending to keep it in said first state.
- The control member is a crown rotatably mounted in relation to said case, in a middle thereof.
- The control member is a rotating bezel.
- The control member is the bottom that closes the case, rotatably mounted in reference to the case.

The control member is a crown whereof the head is provided with a structure having a non-circular geometry, said head being housed in a recess formed in the middle of the case.

The control organ is a driving push-piece movably mounted in the case.

The kinematic connection between the control member and the transmission ring can be disengaged.

The transmission ring is driven incrementally.

The control organ is a driving push-piece secured to an asymmetrical connecting element, arranged to cooperate with a toothing formed in the transmission ring to cause it to advance by a predetermined pitch, said driving push-piece being rotatable such that the connecting element can, by rotating 180°, go from a first position in which it can actuate the transmission ring in a first direction, to a second position in which it can actuate the transmission ring in a second direction.

The control organ can also have two push-pieces, respectively arranged to cooperate with the transmission ring to drive it in first and second directions.

The indicator organ is a disk.

BRIEF DESCRIPTION OF THE DRAWINGS

Other details of the invention will appear more clearly upon reading the following description, done in reference to the appended drawing, in which:

FIGS. 3*a*, 3*b*, 3*c* and 4*a*, 4*b*, 4*c* and 5*a*, 5*b* illustrate various possible displays for a timepiece according to the invention.

DETAILED DESCRIPTION OF THE INVENTION

Figure 1:
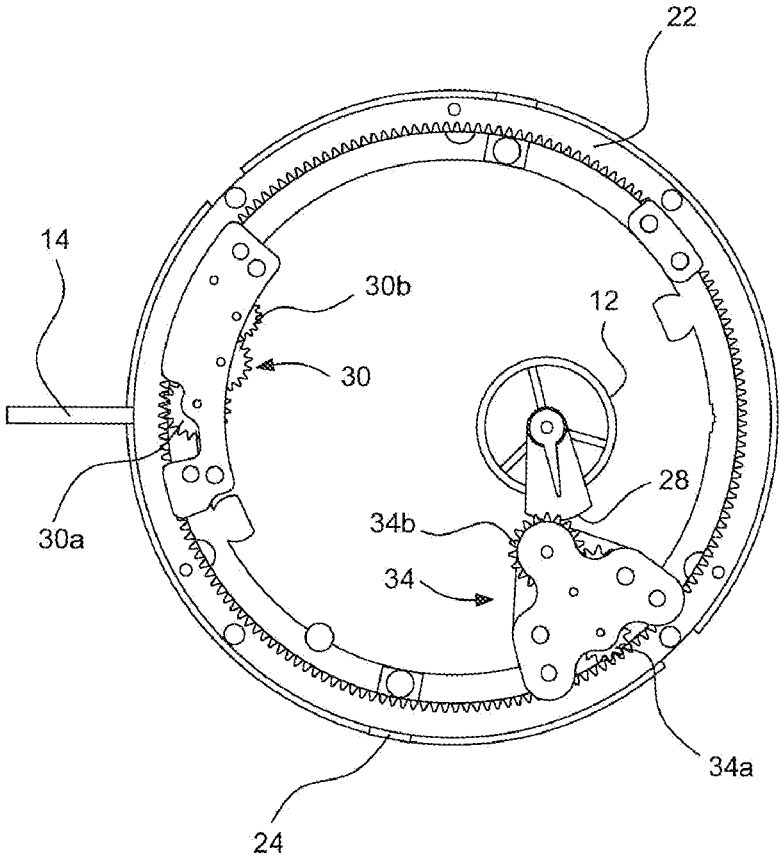
FIGS. 1 and 2 illustrate possible constructions of a timepiece according to the invention.

The invention relates to a mechanical timepiece comprising a movement 10 provided with a sprung balance 12 associated with a balance-spring, shown diagrammatically in FIG. 1. Like a sprung balance 12 of the state of the art, the movement 10 is equipped with a system for adjusting the active length of the balance-spring, rotatably movable, known by those skilled in the art as an index and described in the introduction of this application.

The timepiece also comprises a control organ 14 accessible to a user from outside the timepiece, arranged so as to allow that user to act on the system for adjusting the active length of the balance-spring from outside the timepiece, without having to open the case in which the movement 10 is housed.

Figure 6A:
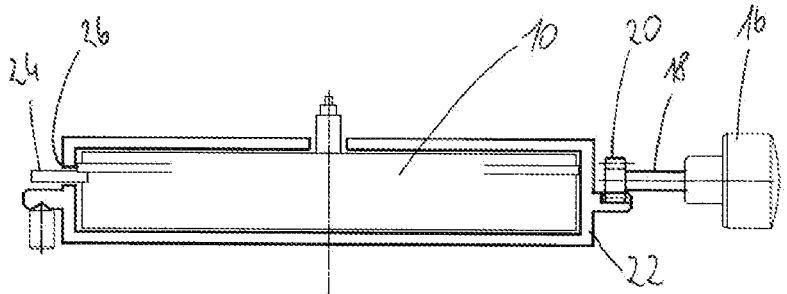
FIGS. 6 to 11 show alternatives of the invention.

In one preferred embodiment, the control organ 14 is a crown 16 rotatably mounted in reference to the case, on a stem 18 pivoting in the middle of the case, similarly to a winding stem. As proposed in FIG. 6*a*, the stem 18 has a pinion 20 secured to the crown 16 at its end.

This pinion 20 is mounted engaged with a transmission ring 22 rotatably mounted at the periphery of the movement 10 on a frame. In one preferred embodiment, the transmission ring 22 and the movement 10 are concentric. The movement 10 can thus be arranged inside the transmission ring 22, which allows a reduced thickness of the entire construction. In the figures, one can in particular see that the movement 10 is secured to the case using fastening brackets or clamps 24 or any other suitable element, not hindering the movements of the transmission ring 22. One can see that, in certain illustrations, the transmission ring 22 assumes the form of an enclosure in which the movement 10 can be placed. In this type of construction, the clamps 24 can be arranged in openings 26 formed in the transmission ring 22 so as to leave the movements of the transmission ring 22 free.

In addition to being kinematically connected to the control organ 14, the transmission ring 22 is also kinematically connected to the adjustment system. To that end, different options are possible. One preferred option consists of connecting the transmission ring 22 and the index by meshing, using a rack 28 or a toothed sector secured to the index and diagrammatically shown in FIG. 1.

It is particularly useful for the user to have an indication of the adjustment to the operation of the timepiece, so as to allow the user to perform a precise adjustment. To that end, a display train 30 kinematically connected to the transmission ring 22 is arranged to drive an indicator organ, designed to display the value of the adjustment applied to the active length of the spring.

According to one interesting aspect of the invention, this display train 30 is made up of wheels 30*a*, 30*b* mounted on a first independent module, assembled to the frame. More specifically, the display train 30 includes a first wheel 30*a* engaged with the transmission ring 22, then a series of wheels making it possible to adjust the gear ratio between the transmission ring 22 and the indicator organ, so as to have a clear and readable display. The indicator organ can be a hand mounted on the staff of the last wheel of the display train 30. As it will be seen later, a display by disc can also be considered. The wheels of the display train are mounted between a plate and a bridge 32 or between two bars, forming an independent module, which can be arranged in any locations of the movement 10, concentrically to the transmission ring 22, so as to preserve the meshing between that transmission ring 22 and the first wheel 30*a* of the display train 30. In this way, it is relatively easy for one skilled in the art to adapt its construction so as to have an indictor member where he wishes.

Advantageously, the transmission ring 22 can be kinematically connected to the adjustment system by a transmission train 34 made up of wheels 34*a*, 34*b* mounted on a second independent module, assembled to said frame. The construction of the independent module is similar to that described above relative to the display train and uses at least one bridge also bearing reference 32. The transmission train 34 makes it possible to adapt the transmission ratio so as to have a subtle adjustment of the position of the index. In the case of a kinematic connection through meshing with the system for adjusting the active length of the balance-spring, the last wheel 30*b* of the display train 30 engages with the rack 28 of the index. The modular construction also makes it possible to adapt the device to various movements, by adapting to the position of the regulator organ.

Other options are possible for the kinematic connection between the adjustment system and the transmission ring 22, in particular by engaging along the arm of the index in a housing of the last wheel of the display train.

The adjustment of the operation of the watch, by acting on the system for adjusting the active length of the balance-spring, theoretically should only be used for subtle adjustments, in the vicinity of several seconds (approximately ten seconds) forward or backward per day. If the movement 10 were to require a more significant correction, due to aging problems, impacts, or other parameters, the timepiece would then need to be brought to an horologist for complete maintenance and, if necessary, to identify and correct a particular problem. Thus, advantageously, the display of the adjustment of the active length of the balance-spring can be completed by means for displaying a service indication 40 indicating that the movement of the adjustment system has exceeded a predetermined value, beyond which it is considered that complete maintenance is necessary.

This service indication may be displayed by various means. The indicator organ itself can, beyond a graduation indicating the adjustment value, indicate that service is necessary (see FIG. 5*b*). It is also possible to use the transmission ring 22 to indicate that information, since the position of the transmission ring 22 reflects the position of the index. Markings may therefore be affixed on the ring, those markings being able to appear to the user in an ad hoc window. Advantageously, the window can be formed in the dial 42, the middle 44 of the case or in the bottom 46 of the case, the marking being able to be arranged on either of the surfaces of the transmission ring, i.e. on its upper surface, so as to be visible on the dial side 42, on an outer side surface, so as to be visible through the middle 44, or on its lower surface, so as to be visible on the bottom side 46.

Figure 3A:
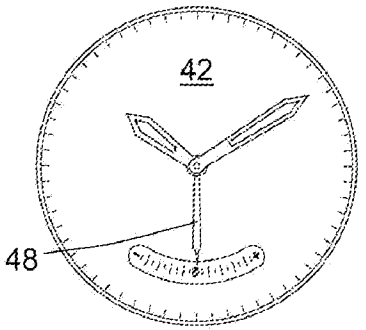
Figure 3B:
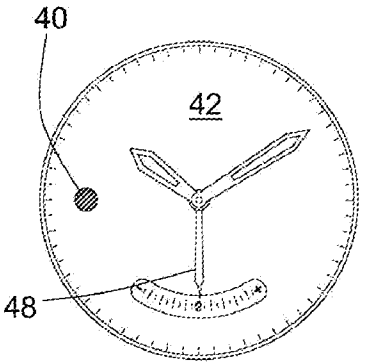
Figure 3C:
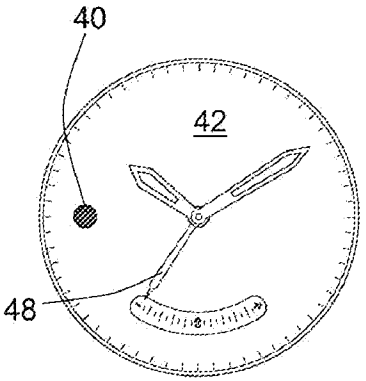
Figure 4A:
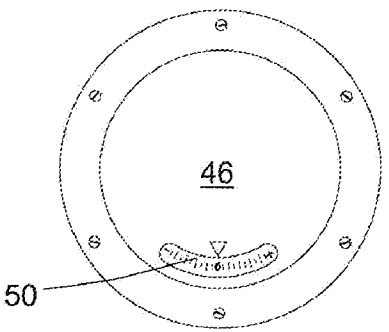
Figure 4B:
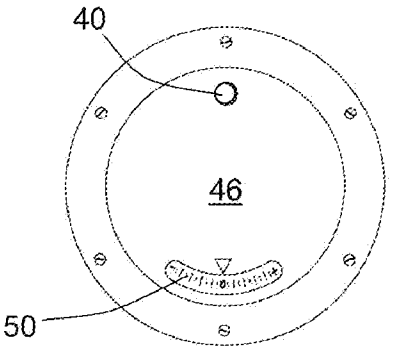
Figure 4C:
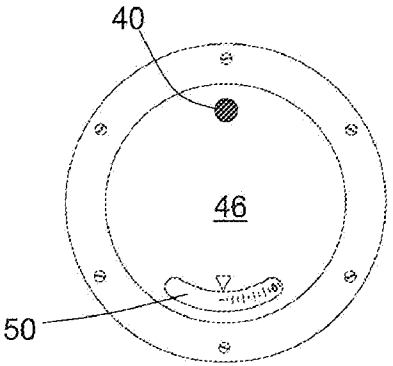

Thus, as shown in FIGS. 3 and 4, the indicator organ (a movable hand 48 opposite a graduated scale in FIGS. 3, and a movable graduated disc 50 opposite a fixed index for FIGS. 4) displays the adjustment of the operation. In FIGS. 3, the indications are visible on the dial. In an aperture shown in FIGS. 3*b* and 3*c*, the marking affixed on the transmission ring 22 is visible. When the adjustment value is comprised in a predefined admissible range, the marking is for example a first color (FIG. 3*b*). When the adjustment value is beyond that admissible range, the marking proposes another color (FIG. 3*c*). A similar illustration is provided in FIGS. 4, but on the bottom side 46, including for the indicator organ displaying the adjustment of the active length of the balance-spring. As an illustration, FIG. 5 shows a display visible at the middle 44 of the watch case. The possibilities offered in terms of design and positioning of the displays are quite varied.

It is known that the position of the adjustment organ may be sensitive to impacts. Thus, it may be useful, to guarantee and maintain an adjustment that has been done, to provide for locking of the adjustment system. Given that the control member 14, the transmission ring 22, and the system for adjusting the active length of the balance-spring are kinematically connected, it is possible to act on one or another of these elements to ensure maintenance of the adjustment.

It may be advantageous to provide that maintenance by locking the transmission ring 22, for example by blocking the rotation of the latter part using at least one ball click 52 arranged to cooperate with a plurality of housings 54. The ball click system 52 may be arranged in the transmission ring 22 and the housings 54 in the frame, but the opposite is also possible. In a ball click 52, the ball is pressed by the spring so as to protrude and engage in the corresponding housings 54. Only a sufficient force, resulting from a deliberate action on the control organ, makes it possible to move the transmission ring 22, while impacts occurring during normal use have no effect.

Figure 6B:
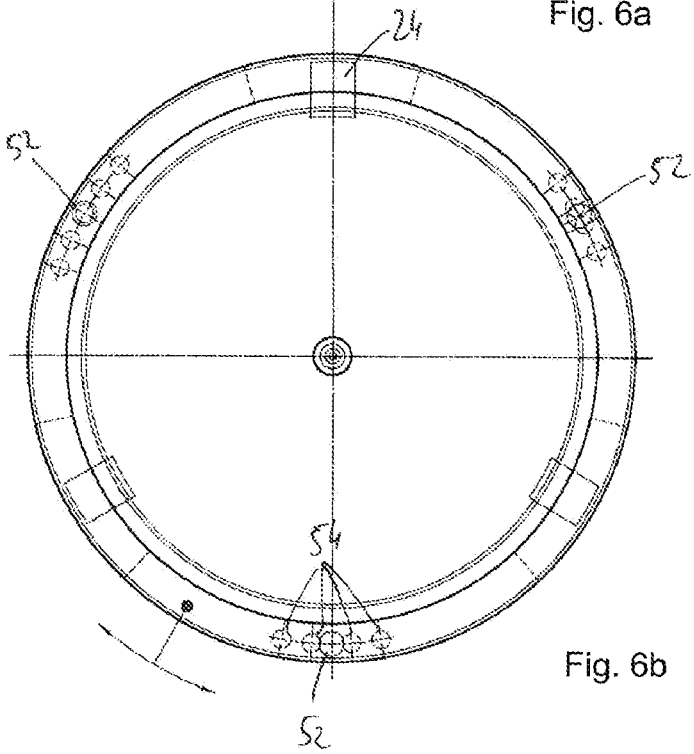

FIG. 6 shows three ball clicks 52, substantially distributed around the transmission ring 22. Such a distribution makes it possible to improve the stability of the ring. Furthermore, the three clicks 52 can be slightly offset relative to an exact distribution. Thus, the clicks 52 do not act at the same time, but in turn. This makes it possible to have stable successive positions separated by an angle smaller than the pitch separating the housings 54, that pitch depending on the size of the ball of the click. It is thus possible to express the angular gap between clicks as 360/N−P/N, where N is the number of clicks and P is the pitch separating two consecutive housings 54 cooperating with a click, in the case where that pitch is constant.

A jumper (not shown) cooperating with teeth, for example situated inside the transmission ring 22, may also allow locking comparable to that offered by the ball click(s) 52.

Figure 8A:
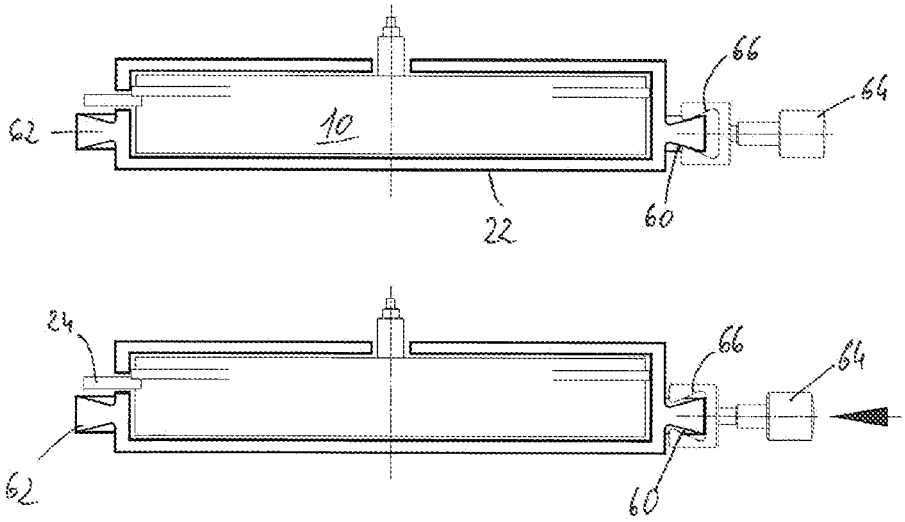

FIGS. 8*a* and 8*b* propose another solution making it possible to lock the position of the transmission ring 22. In that case, the transmission ring 22 comprises at least one braking surface 60, for example assuming the form of a rim 62 arranged protruding at the outer periphery of the ring. The rim 62 can have a dovetail section, the secant opposite surfaces of which define the braking surfaces. Furthermore, the timepiece comprises a locking member 64 accessible from outside the timepiece, secured to a brake 66 arranged to cooperate with the braking surface 60. The locking organ 64 is movably mounted and able to move between a first state, in which the brake 66 bears against the braking surface 60, and a second state, in which the brake 66 leaves the braking surface 60 free, a locking spring being arranged to exert a force on the locking organ 64 tending to keep it in said first state. For example, the locking organ 64 assumes the form of a push-piece, secured to a clamp, inside which the rim of the transmission ring is engaged. The clamp has a section substantially corresponding to that of the transmission ring, while allowing it to move between its two states, shown in figures a and b, respectively. One can see that, in figure a, the clamp presses on the braking surfaces 60, under the action of a spring not shown, blocking the rotation of the transmission ring 22. It is necessary to press on the push-piece so as, while simultaneously actuating the control member 14, to adjust the active length of the balance-spring.

Other locking means may also be provided. For example, in the case where the control organ 14 is a crown 16 rotatably mounted in reference to the case, in a middle comprised by the latter, a crown 16 of the screwed type can be provided. Thus, when the latter is screwed, the position of the adjustment system is locked.

Figure 2:
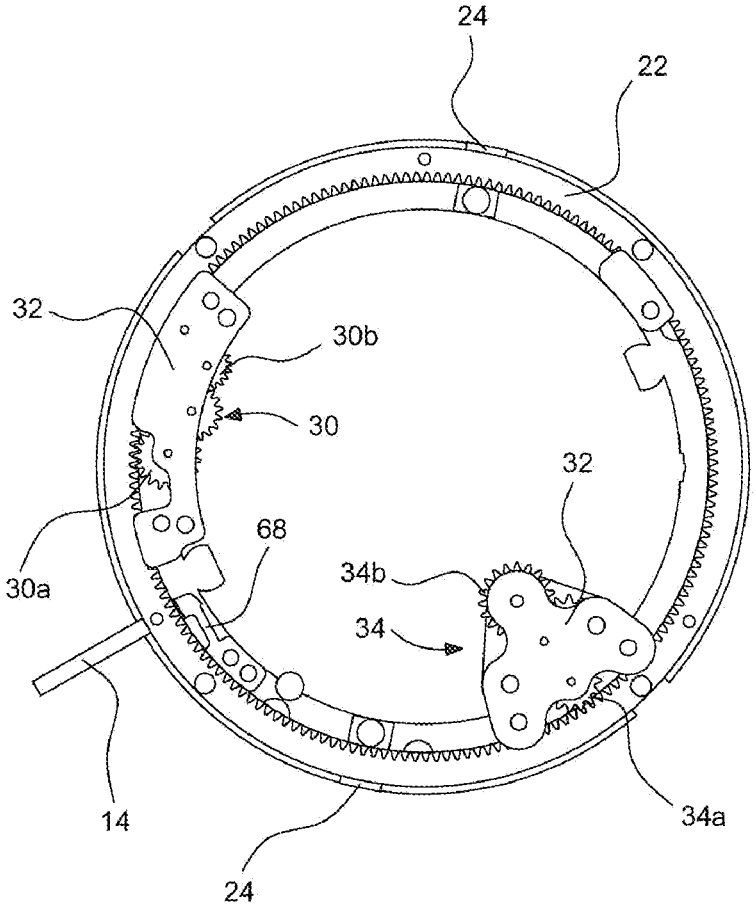

In FIG. 2, a bolt 68 is arranged at the staff 18. This bolt can assume the form of a lug comprising an opening through which the staff 18 passes. The shape of the opening of the lug and that of the staff are arranged such that the staff 18 must be pulled for the rotation of the crown to be possible. This can for example be obtained by having, on the staff, two adjacent portions with different sections, one being able to pivot inside the opening of the lug, the other not allowing such pivoting.

Figure 7A:
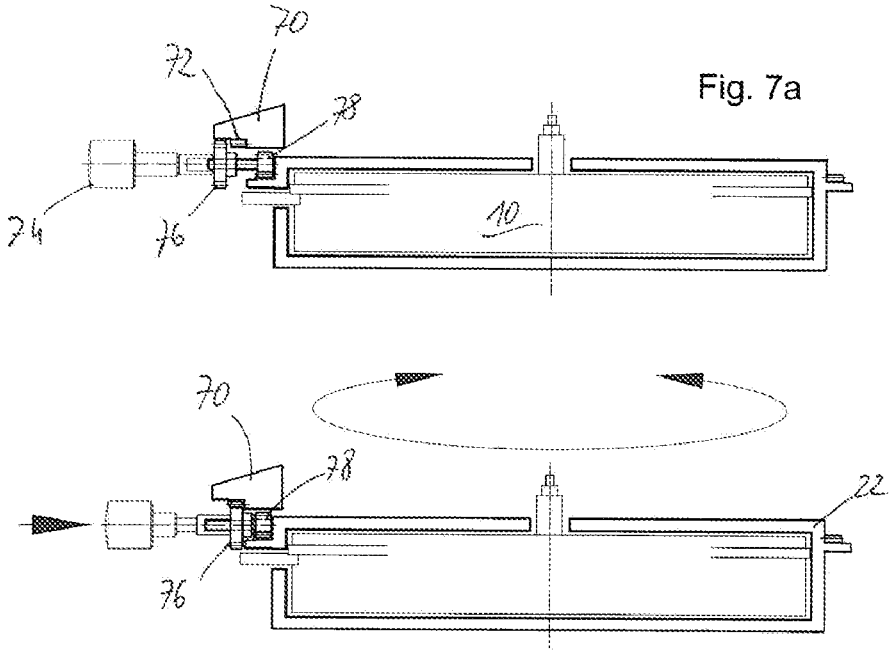

FIGS. 7*a* and 7*b* propose an embodiment in which the control organ 14 is a rotating bezel 70. In the illustrated alternative, it is proposed to produce the kinematic connection between the rotary bezel 70 and the transmission ring 22 so that it can be disengaged, such a construction being transposable to other control organs 14. Thus, one can see, in FIG. 7*a*, that the rotary bezel 70 comprises a toothing 72 on its inner face oriented on the bottom side. Furthermore, the timepiece comprises a push-piece 74 supporting a castle-wheel 76. The latter is arranged so as, when the push-piece is actuated, to mesh with the toothing 72 of the rotary bezel 70. On the arbor of the castle-wheel 76, a second pinion 78 meshes continuously with the transmission ring 22. Thus, when the push-piece 74 is not actuated, the rotary bezel 70 is disengaged from the transmission ring 22 and rotating the rotary bezel 70 has no impact on the adjustment of the operation of the movement 10. However, an action on the push-piece 74 engages the castle-wheel 76, and the rotary bezel 70 is then kinematically connected to the system for adjusting the active length of the balance-spring. It is then possible to perform an adjustment.

Figure 10:
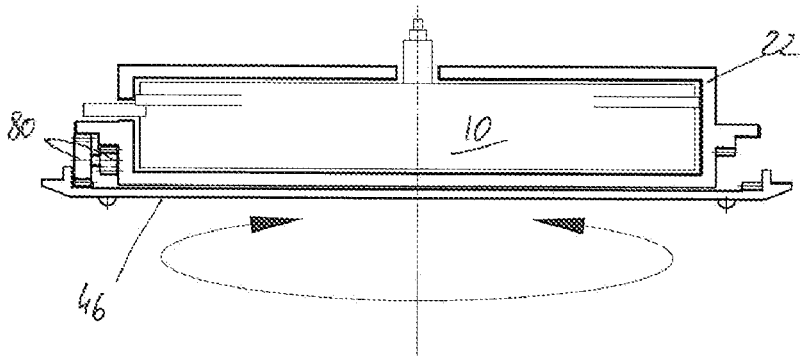

In FIG. 10, it is proposed to use the bottom 46 of the case as control organ. In this alternative, the bottom 46 is rotatably mounted in reference to the case, like a rotary bezel 70. It is possible to propose a disengageable connection, as proposed above, or a permanent connection, as illustrated in the figure. In the proposed example, the bottom 46 comprises a toothing 46*a* connected to the transmission ring 22 by two toothed wheels 80 mounted on an arbor.

Figure 11:
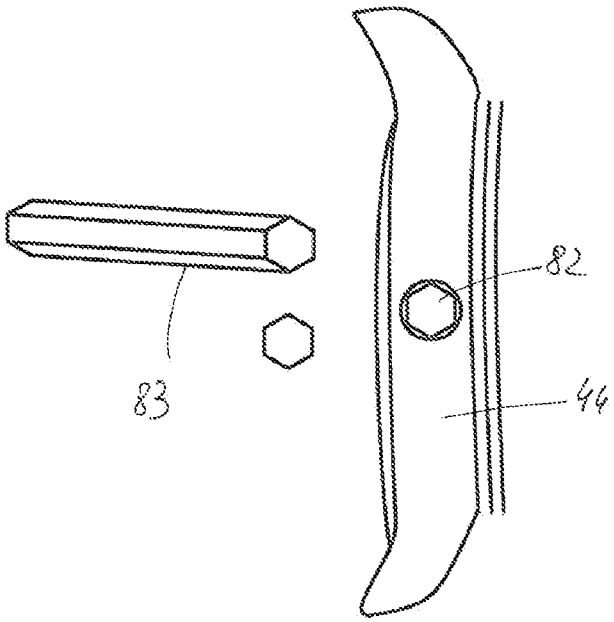

In another alternative shown in FIG. 11, the control organ 14 is a crown 16 whereof the head is provided with a structure having a non-circular geometry 82. The structure is raised, and may be positive or negative in relation to the level of the head. The head is housed in a hollow formed in the middle 44 of the case and does not protrude past the case. It is thus necessary to use a tool 83 configured to cooperate with said structure to perform the adjustment, and accidental driving is not possible.

Figure 9A:
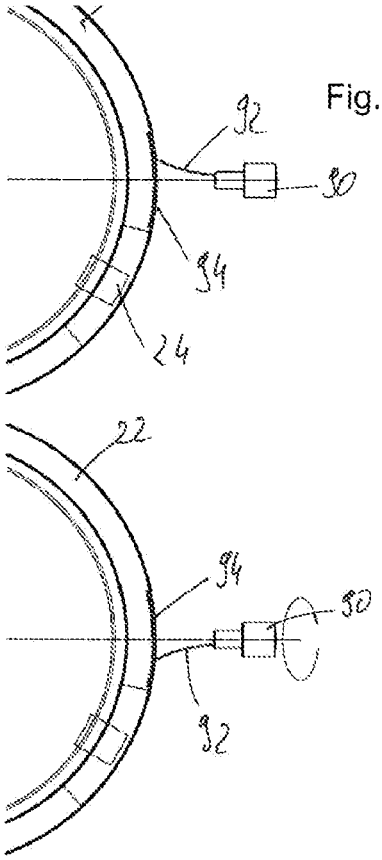

FIGS. 9*a* and 9*b* propose an additional alternative in which the control organ 14 is a driving push-piece 90 movably mounted in the case, following a substantially radial translational movement, in reference to the center of the movement 10 and following a rotational movement around its axis. The driving push-piece 90 is secured to an asymmetrical connecting element, shown by an asymmetrical flexible strip 92, the end of which can cooperate with an outer toothing 94 comprised by the transmission ring 22, when pressure is exerted on the driving push-piece 90. The term asymmetrical means that the connecting element, in this case the end of the flexible strip 92, acts in an off-center manner in relation to the axis of the push-piece, on the outer toothing 94. This arrangement produces the disengageable connection between the control organ 14 and the transmission ring 22. The flexible strip 92 is only one example. It is also possible to provide a tilting finger, similar to a snapping system.

Thus, owing to the fact that the driving push-piece 90 can pivot, it can occupy a first position (FIG. 9*a*) in which the end of the flexible strip 92 can actuating the transmission ring 22 in a first direction. By a 180° rotation, the driving push-piece 90 can occupy a second position (FIG. 9*b*) in which the end of the strip can actuate the transmission ring 22 in a second direction. Upon each pressure exerted on the driving push-piece 90, the transmission ring 22 advances by one pitch, corresponding to the pitch of the outer toothing 94. The latter is advantageously arranged so that one pitch corresponds to an adjustment of one second.

Advantageously, the first and second positions of the driving push-piece 90 are indexed by indexing means to be chosen by a person skilled in the art. A simple placement of the driving push-piece 90 in rotational abutment, coupled with sufficient friction of the rotation, allows the user to identify that the push-piece is indeed in one or the other of the first and second positions.

The driving push-piece 90 proposed in FIG. 9 may be replaced by two push-pieces, respectively arranged to cooperate with the transmission ring 22 to drive it in first and second directions.

Among the different embodiments proposed above, several propose incremental driving of the transmission ring. In particular, using one or two push-pieces as the control organ 14 involves incremental driving. Furthermore, the presence of ball clicks 52 or a jumper at the transmission ring 22 also involves incremental driving.

The incremental movement of the transmission ring 22 makes it possible to have jumping driving of the indicator organ. Thus, advantageously, the indicator organ may be a disc 50 visible through an aperture.

The different alternatives proposed for the control organ 14 are compatible with the use of independent modules to support the transmission train 34 or the display train 30. It will also be noted that these different control organs can also be implemented with a transmission ring kinematically connected to the adjustment system or to an indicator organ in any manner whatsoever, i.e. without implementing independent modules, which makes it possible not to exclude any subsequent patent filings, based on this description, specifically pertaining to the different alternative control organs, or organs for locking the adjustment system or disengaging the kinematic connection between the control organ and the transmission ring.

The invention claimed is:

1. A timepiece comprising a movement provided with a sprung balance associated with a balance-spring, equipped with an adjustment system for adjusting the active length of said balance-spring, rotatably movable, a control organ accessible to a user from outside the timepiece, a transmission ring rotatably mounted on the periphery of the movement on a frame, said movement being arranged inside said transmission ring, the transmission ring on the one hand being kinematically connected or connectable to the control organ, and on the other hand kinematically connected to said adjustment system, a display train kinematically connected to the transmission ring and driving an indicator organ, designed to display the value of the adjustment applied to the active length of the balance-spring, wherein the display train is made up of wheels mounted on a first independent module, assembled to said frame.

2. The timepiece of claim 1, wherein the transmission ring is kinematically connected to the adjustment system by a transmission train made up of wheels mounted on a second independent module, assembled to said frame.

3. The timepiece of claim 1, comprising means for displaying a service indication indicating that the movement of the adjustment system has exceeded a predetermined value.

4. The timepiece of claim 2, comprising means for displaying a service indication indicating that the movement of the adjustment system has exceeded a predetermined value.

5. The timepiece of claim 3, wherein the movement is housed in a case closed by a bottom and a glass, said movement being topped by a dial visible through the glass, said transmission ring bearing a marking and the dial, the case or the bottom comprising an opening through which said marking is visible, to indicate the service information.

6. The timepiece of claim 4, wherein the movement is housed in a case closed by a bottom and a glass, said movement being topped by a dial visible through the glass, said transmission ring bearing a marking and the dial, the case or the bottom comprising an opening through which said marking is visible, to indicate the service information.

7. The timepiece according to claim 1, wherein the position of the adjustment system can be locked.

8. The timepiece of claim 7, wherein the position of the adjustment system can be locked by locking the transmission ring.

9. The timepiece of claim 8, wherein the rotation of the transmission ring can be blocked by at least one ball click system arranged to cooperate with a plurality of housings, the ball click system or the plurality of housings being arranged in the transmission ring or in the frame.

10. The timepiece of claim 8, wherein the transmission ring comprises a braking surface and said timepiece comprises a locking member accessible from outside the timepiece, secured to a brake arranged to cooperate with the braking surface, said locking member being movably mounted and being capable of going between a first state in which the brake bears against the braking surface, and a second state in which the brake leaves the braking surface free, a locking spring being arranged to exert a force on the locking member tending to keep it in said first state.

11. The timepiece according to claim 1, wherein the control member is a crown rotatably mounted in relation to said case, in a middle thereof.

12. The timepiece according to claim 1, wherein the control member (14) is a rotating bezel (70).

13. The timepiece according to claim 1, wherein the case is closed by a bottom and wherein the control member is said bottom rotatably mounted in reference to the case.

14. The timepiece of claim 11, wherein the crown comprises a head provided with a structure having a non-circular geometry, said head being housed in a recess formed in the middle of the case.

15. The timepiece according to claim 1, wherein the control organ is a driving push-piece movably mounted in the case.

16. The timepiece of claim 11, wherein the kinematic connection between the control member and the transmission ring can be disengaged.

17. The timepiece of claim 12, wherein the kinematic connection between the control member and the transmission ring can be disengaged.

18. The timepiece of claim 13, wherein the kinematic connection between the control member and the transmission ring can be disengaged.

19. The timepiece according to claim 1, wherein the transmission ring is driven incrementally.

20. The timepiece of claim 19, wherein the control organ is a driving push-piece secured to an asymmetrical connecting element, arranged to cooperate with a toothing formed in the transmission ring to cause it to advance by a predetermined pitch, said driving push-piece being rotatable such that the connecting element can, by rotating 180°, go from a first position in which it can actuate the transmission ring in a first direction, to a second position in which it can actuate the transmission ring in a second direction.

21. The timepiece of claim 19, wherein the control organ has two push-pieces, respectively arranged to cooperate with the transmission ring to drive it in first and second directions.

22. The timepiece of claim 19, wherein the indicator organ is a disk.

* * * * *